United States Patent [19]

Mabry et al.

[11] Patent Number: 4,747,595

[45] Date of Patent: May 31, 1988

[54] EXERCISER FOR WHEELCHAIR OCCUPANTS

[76] Inventors: George D. Mabry, 3257 Beatrice Dr., Jackson, Miss. 39212; Paul H. Pettie, 236 McDowell Park Cir., Jackson, Miss. 39204

[21] Appl. No.: 2,244

[22] Filed: Jan. 12, 1987

[51] Int. Cl.[4] ..... A63B 21/06

[52] U.S. Cl. ..... 272/118; 272/143

[58] Field of Search ..... 272/93, 117, 118, 70, 272/70.3, 900, 143; 280/289 WC, 289 E, 242 WC; 296/65 R; 128/25 R

[56] References Cited

U.S. PATENT DOCUMENTS

| | | | |
|---|---|---|---|
| 1,114,458 | 10/1914 | Friedli | 272/134 |
| 2,556,121 | 6/1951 | Thomas | 272/70.3 |
| 2,572,149 | 10/1951 | Hind | 280/290 |
| 2,718,396 | 9/1955 | Lateau | 272/141 |
| 3,999,762 | 12/1976 | Castor | 272/144 |
| 4,153,244 | 5/1979 | Tauber, Jr. | 272/117 |
| 4,265,478 | 5/1981 | Korsgaard | 280/242 WC |
| 4,325,576 | 4/1982 | Guthrie | 280/289 WC |
| 4,346,888 | 8/1982 | Szabo | 272/118 |
| 4,402,502 | 9/1983 | Peters | 272/143 |
| 4,427,210 | 1/1984 | Wevers | 280/242 WC |

*Primary Examiner*—Richard J. Apley
*Assistant Examiner*—J. Welsh
*Attorney, Agent, or Firm*—Fleit, Jacobson, Cohn & Price

[57] ABSTRACT

The present invention generally relates to exercise equipment and more particularly to such equipment for use by individuals while occupying a wheelchair and incorporates unique structural arrangements that enables the wheelchair occupant to fully exercise major body muscle groups without leaving the wheelchair and without assistance. The exercise equipment enables effective exercising at home, in the gymnasium and at various other facilities accessible to a wheelchair occupant with the equipment including arrangements to securely anchor the wheelchair in various relations to the equipment and to retain the wheelchair occupant within the confines of the wheelchair during various exercise regimens.

11 Claims, 3 Drawing Sheets

34
122
66
47
120
118
70
50
126
130
128
52
110
90
116
94
96
32
92
33
16
54
80

80
116
94
28
96
98
32
110
92
33
16
116

250
212
248
266
220
240
224
222
267
264
216
262
290
216
208
228
263
290
216
234
276
228
258
226
221
216
218
219
242
259

EXERCISER FOR WHEELCHAIR OCCUPANTS

BACKGROUND 0F THE INVENTI0N

1. Field of the Invention

The present invention generally relates to exercise equipment and more particularly to such equipment for use by individuals while occupying a wheelchair and incorporates unique structural arrangements that enables the wheelchair occupant to fully exercise major body muscle groups without leaving the wheelchair and without assistance. The exercise equipment enables effective exercising at home, in the gymnasium and at various other facilities accessible to a wheelchair occupant with the equipment including arrangements to securely anchor the wheelchair in various relations to the equipment and to retain the wheelchair occupant within the confines of the wheelchair during various exercise regimens.

2. Information Disclosure Statement

Various types of exercise equipment have been provided for use in the home, gymnasium and other facilities specifically adapted for exercising. Such devices include arrangements which enable wheelchair occupants to perform certain exercise procedures. The prior art known to applicants will be submitted and discussed in a subsequently filed Information Disclosure Statement.

SUMMARY OF THE INVENTION

An object of the present invention is to provide exercise equipment for independent home use, gymnasium use, medical facility therapy use for individuals that may be either temporarily or permanently confined to wheelchairs and consists of a framework partially surrounding the wheelchair with facilities for stabilizing the wheelchair and its occupant to enable various exercise regimens to be followed by the wheelchair occupant while in a comfortable and secure relation to the wheelchair and the exercise equipment.

Another object of the invention is to provide exercise equipment in accordance with the preceding object in which the framework is constructed to accommodate various standard wheelchairs with the wheelchair being associated with the frame in both a forward and reverse position by the use of interchangeable grips, anchoring devices, harnesses and the like in order to enable multiple exercises for various muscle groups to be performed by utilizing the weight stacks associated with the framework.

Still another object of the invention is to provide exercise equipment in accordance with the preceding objects in which the wheelchair and its occupant can be safely secured in the framework by adjustable stops, lap safety belt arrangements and frame straps which cooperate to securely lock the wheelchair in position in relation to the framework with the wheelchair either moved forwardly into the framework or moved rearwardly into the framework which can be accomplished without outside assistance and which enables various exercise regimens to be effectively followed.

Still another object of the invention is to provide exercise equipment for wheelchair occupants in accordance with the proceding objects which is rugged in construction, flexible in use, effective for enabling wheelchair occupants to follow various exercise regimens and capable of use in various facilities.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
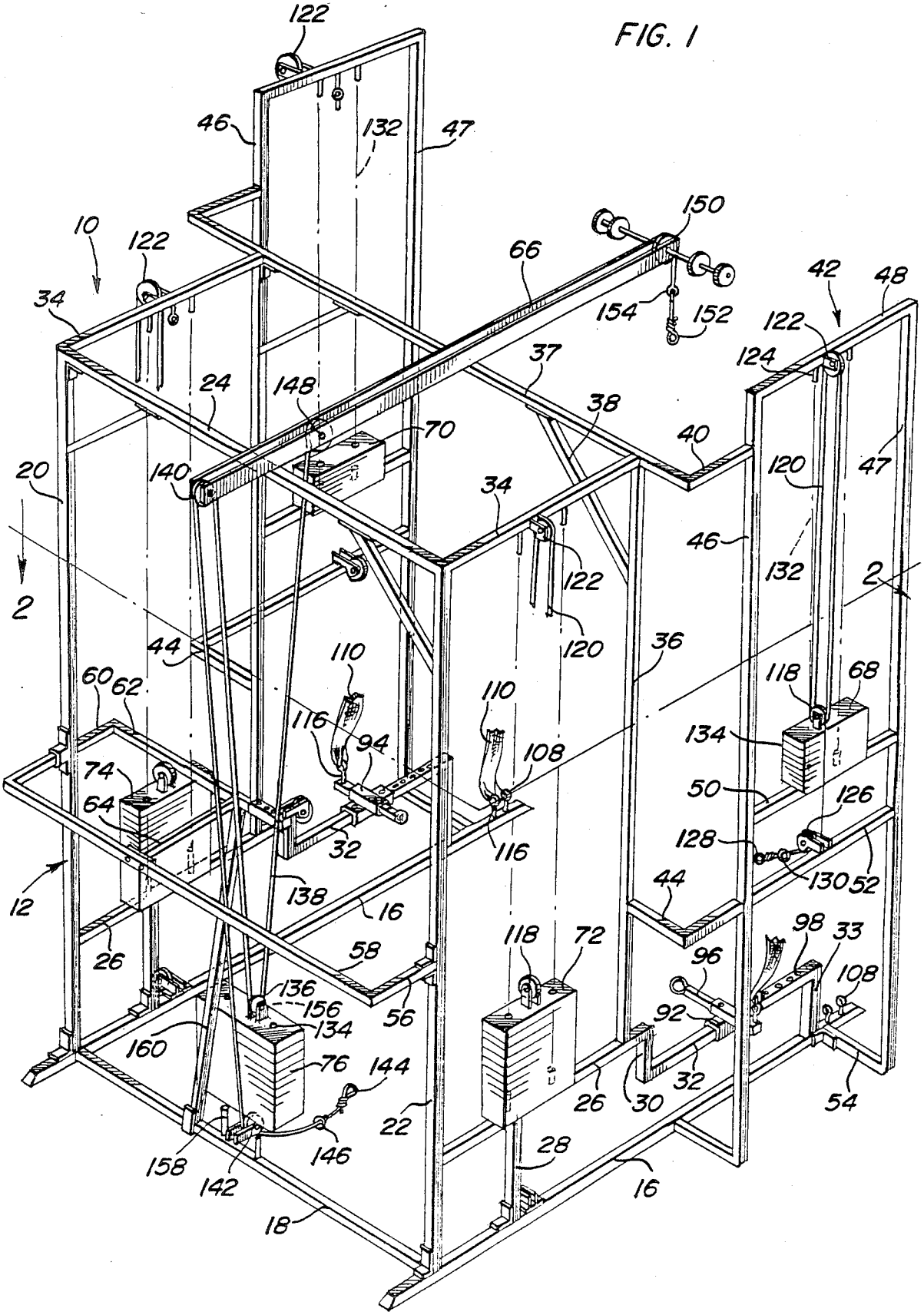
FIG. 1 is a perspective view of the exercise equipment of the present invention illustrating the structure of the framework and position of various of the weight stacks and other components of the invention.
Figure 2:
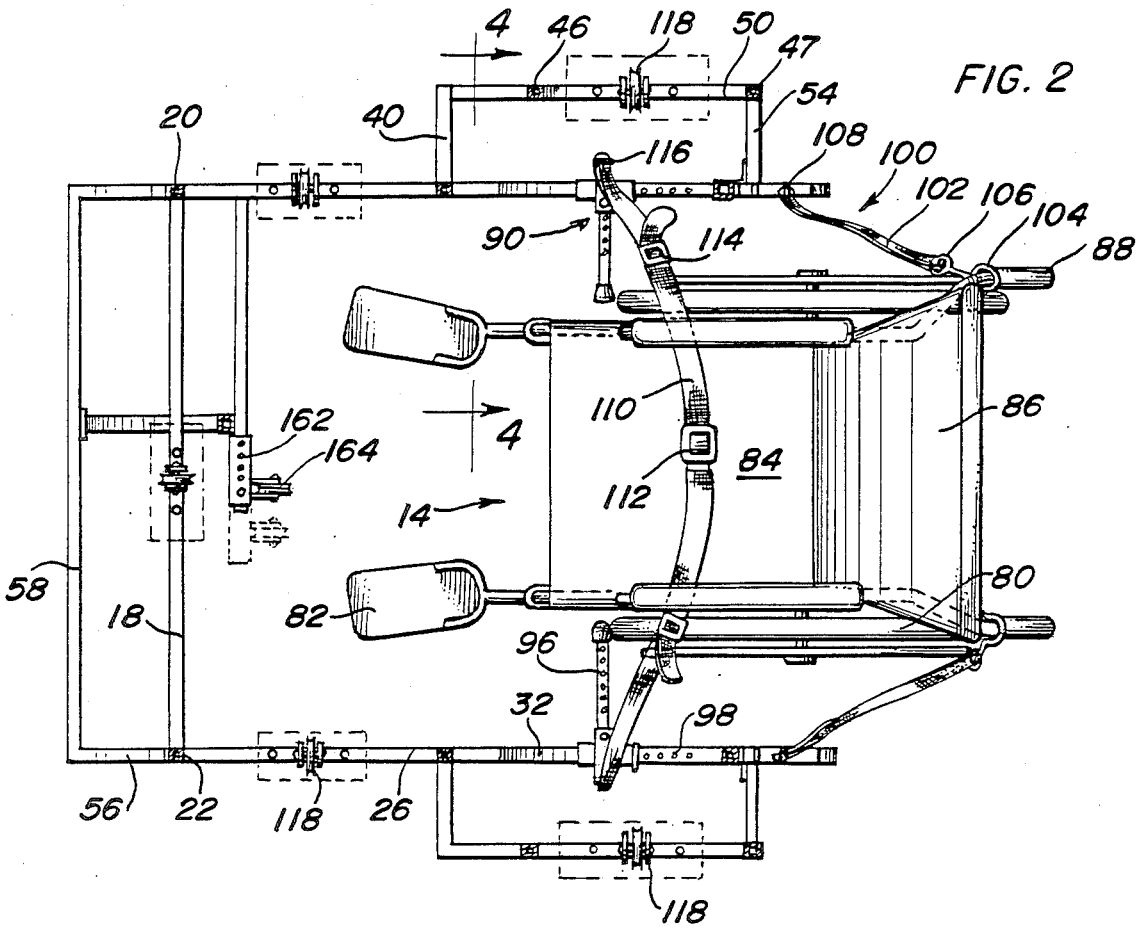
FIG. 2 is a top plan view of the exercise equipment illustrating the position of the wheelchair therein when facing forwardly.
Figure 3:
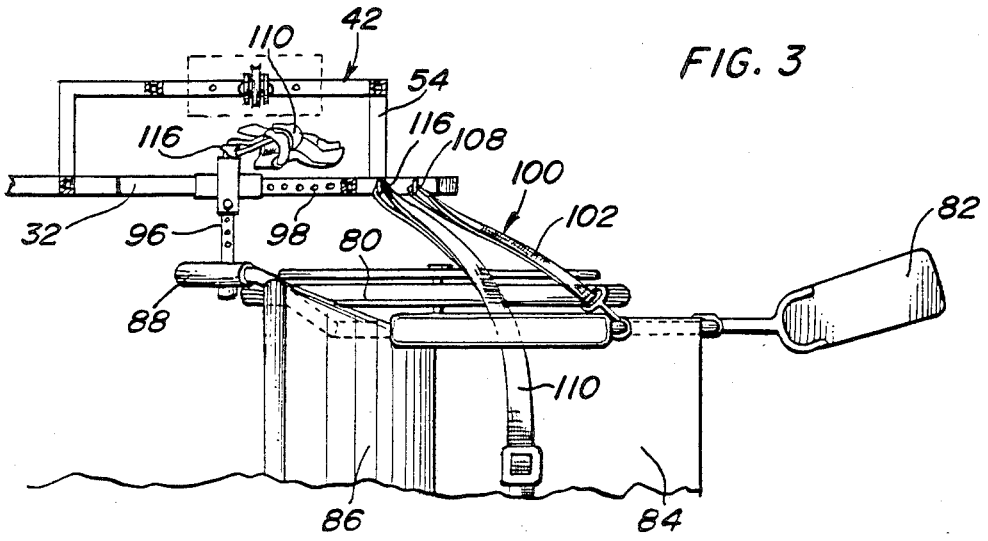
FIG. 3 is a fragmental plan view similar to FIG. 2 but with the wheelchair facing rearwardly.
Figure 4:
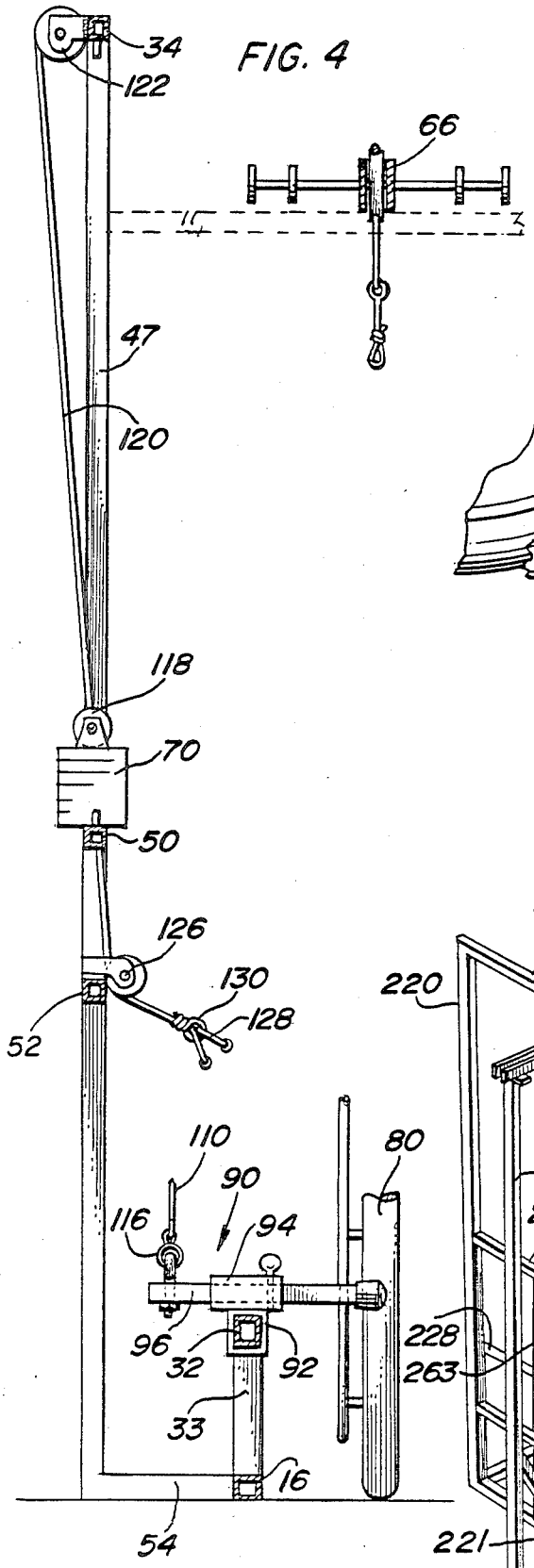
FIG. 4 is a transverse, sectional view taken substantially upon a plane passing along section line 4—4 on FIG. 2 illustrating further structural details of the exercise equipment.
Figure 5:
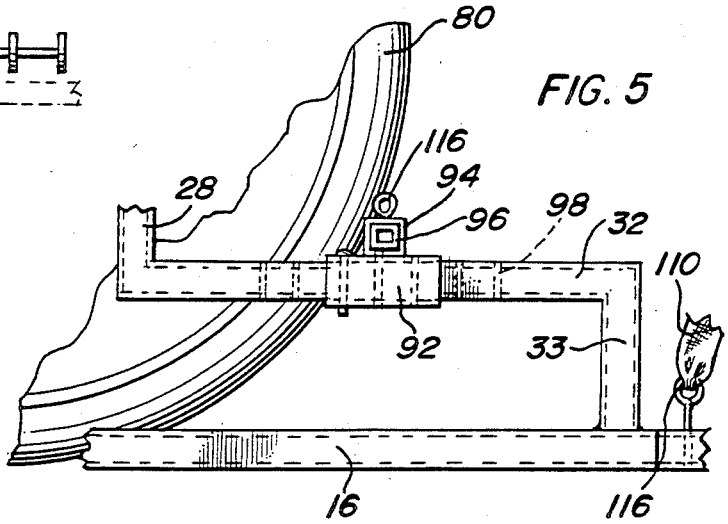
FIG. 5 is a fragmental elevational view of a portion of the equipment.

Referring now specifically to the drawings, the exerciser of the present invention is generally designated by reference numeral 10 and includes a generally vertically disposed framework 12 that may be considered substantially U-shaped when viewed from the top as illustrated in FIG. 2 so that a wheelchair 14 can be moved into the framework when facing forwardly as illustrated in FIG. 2 or rearwardly as illustrated in FIG. 3. The framework 12 includes bottom side members 16 which generally define the sides of the framework and are substantially parallel to each other and spaced laterally from each other to define side members that are rigidly interconnected by an end frame member 18. Extending upwardly from the juncture between the side members 16 and the end member 18 is a pair of vertical front corner members 20 and 22 with the upper ends thereof being interconnected by an upper end member 24. Positioned above each of the side members 16 in vertically spaced parallel relation thereto is a partial side member 26 lying in the same plane as the side member 18 with the forward end of the member 26 being connected to the front corner member 20 or 22. A vertical brace member 28 extends between the side member 16 and the partial side member 26 in spaced parallel relation to the respective corner members 20 and 22. The side member 28 includes a downwardly offset portion 30 and a longitudinally extending portion 32 which terminates in a downwardly extending end 33 that is rigidly affixed to the side member 16 adjacent the end thereof remote from the front corner members 20 and 22. The upper ends of the front corner members 20 and 22 include upper side members 34 attached thereto which are parallel to the lower side members 16 and of a length slightly less than the side members 26 with vertical members 36 extending downwardly from the ends of the top side members 34 to the side members 26. The ends of the side members 34 remote from the upper end member 24 are interconnected by a member 37 which parallels the end member 24 and extends outwardly beyond the upper side members 34 as illustrated in FIG. 1. Diagonal braces 38 rigidify the end member 37 and the vertical members 36. The outer ends of the member 37 are provided with partial side members 40 which are generally parallel to the side members 34 but spaced outwardly therefrom as illustrated in FIG. 1 with a side frame generally designated by numeral 42 being connected to each of the side members 40. An L-shaped support 44 interconnects each frame 42 and the vertical member 36 at a point spaced above the side members 26 with the structure being duplicated on each side of the framework. The vertical side frame 42 includes spaced vertical parallel members 46 and 47 rigidly interconnected by a top member 48 which is spaced above the member 40 and further interconnected by members 50 and 52 which are parallel to each other and parallel to the top member 48 with the member 52 forming a continuation of the member 44. The lower ends of the vertical members 46 include an inwardly extending portion 54 rigidly affixed to the side member 16.

The forward end of the framework 12 includes a pair of forwardly extending members 56 rigid with the front corner members 20 and 22 with the members 56 being interconnected by an end member 58 that parallels the end member 18 and is located above the end member 18 and spaced forwardly therefrom. A side member 60 forms an extension of the side member 56 on the opposite side of the corner member 20 and a partial end member 62 parallels end member 58 and extends in parallel relation thereto inwardly of the corner member 20 with a connecting member 64 extending between the end portion of the end member 62 and the end member 58. A top rail 66 is supported centrally of the members 24 and 37 and extends both forwardly and rearwardly beyond these two members. The framework may be constructed of rigid hollow tubular metal members interconnected rigidly in any suitable manner commensurate with the strength requirements of the device. The two vertical side frames 42 provide a space for a stack of weights 68 and 70 and a stacks of weights 72 is located above the side frame member 26 between the members 22 and 36 and likewise a stack of weights 74 is located on the opposite side of the framework. A stack of weights 76 is oriented inwardly of the end member 18 and generally aligned with the space between the end member 58 and the end member 62 for vertical movement by the use of cable and pulley assemblies and handgrips accessible to the user of the exerciser in a manner described hereinafter.

As illustrated in FIG. 2, the wheelchair 14 is of conventional construction and includes large side wheels 80, foot supports 82, a seat 84, a seat back 86 and a frame with handgrips 88 with smaller wheels also being provided at the front of the wheelchair in a conventional manner. When an occupant of the wheelchair 14 wants to use the exercise equipment, he will propel the wheelchair inwardly of the framework from the open end thereof opposite to the end member 58 until the wheels 80 come into contact with adjustable stop assemblies 90 which are mounted on and extend inwardly from the elevated side members 32. Each stop assembly 90 includes a sleeve 92 slidable on member 32 and a sleeve 94 perpendicular to and rigid with the sleeve 92 which slidably receives a stop member 96. Both the side member 32 and the slidable stop member 96 are provided with a plurality of spaced openings 98 removably receiving anchoring pins in order to adjust the stop member 96 longitudinally of the side member 32 and in order to adjust the stop member 96 laterally inwardly and outwardly so that the inner end of the stop member 96 will be oriented in position so that the periphery of the wheels 80 of the wheelchair will come into contact with the stop members 96 when the wheelchair is moved inwardly into the framework regardless of whether the wheelchair is moved forwardly into the framework or moved rearwardly into the framework as illustrated in FIGS. 2 and 3 respectively. Thus, the stop members provide a positive and stable anchor point for the wheelchair wheels in that the wheelchair wheels cannot move beyond the adjusted stop members.

When the wheelchair 14 faces forwardly and is moved forwardly into the framework, the wheels 80 come into contact with the properly adjusted stops 90 at the forward peripheral edges thereof upwardly from the point of contact of the wheels with a supporting surface but below the horizontal center of the wheels. To retain the wheelchair 14 in position with the wheels 80 engaging the stops 90, an anchor strap assembly 100 is provided at each side of the wheelchair to connect the frame of the wheelchair with the side members 16 and includes a strap 102 having a hook 104 on the free end thereof for engagement with the frame of the wheelchair with the hook being engaged with the rearwardly extending members having the handgrips 88 thereon and extending downwardly and outwardly therefrom with the strap 102 including a length adjustment buckle assembly 106 therein to secure the wheelchair in stable position so that it will not move forwardly or rearwardly or to either side. The end of the strap 102 is connected to an eyebolt 108 attached to the end portion of the side members 16 remote from the front corner members 20 and 22. Thus, by hooking the hooks 104 onto the frame or handle areas 88 at their juncture with the vertical frame members of the wheelchair frame, the wheelchair can be securely positioned with the wheels engaging the inner end portions of the stops 90 which may be provided with a cushioning cap on the inner end thereof.

In order to stabilize the occupant of the wheelchair, a safety belt assembly 110 extends across the lap area of the occupant. The strap 110 includes a connecting buckle 112 and an adjustment buckle or connector 114 which may be similar to structures used in automotive seatbelts. The ends of the belt or strap 110 are anchored to the framework 12 from an eyebolt 116 on the outer end of the adjustable stop member 96 on the rear end portion of side member 16. The safety belt 110 extends across the lap area just in front of the armrest on the wheelchair or it may be positioned under the armrest and across the lap area or, in some instances, the point of attachment may be varied depending upon the physical requirements of the wheelchair occupant. For example, in some instances, it may be necessary to provide the seatbelt so that it engages the occupant in particular areas in relation to the legs or lower torso depending upon the physical condition of the wheelchair occupant.

As illustrated in FIG. 1, five weight stacks 68–76 are provided with each of the side stacks including a fixed pulley 118 on the upper surface for receiving a cable 120 therethrough with the cable extending over an upper pulley 122 which is fixed to an upper side member 48 or 34. One free end of the cable 120 is anchored at 124 adjacent the fixed upper pulley 122 and extends downwardly under the pulley 118 and upwardly over the pulley 122 and then downwardly through a swivel pulley 126 mounted on frame member 52 on the side frame assemblies 42 with the cable terminating in a hook or loop 128 and including a rubber stop ball 130 which prevents the cable from passing upwardly through the pulley 126. Stationary guides 132 extend between the top frame member 48 and the frame member 50 to guide the weight stack 68 with the weight stack including apertures 134 slidably receiving the guides 132 which may be in the form of cables, rods or the like. Suitable loop-type handles or handgrips or the like may be connected to the loop or hook end 128 on the cable 120 to enable the weight stack 68 to be lifted and lowered by linear movement of the end of the cable. This arrangement of weight stack, cable, guide structure and associated components is the same for the weight stacks 68 and 70 associated with the side frame assemblies 42 and weight stacks 72 and 74 associated with the vertical members 20, 22 and 36. The weight stack structure 76 is similar but somewhat different with the weight stack 76 including a fixed pulley 136 on the upper end thereof receiving a cable 138 thereunder with the cable 138 extending upwardly over a pulley 140 at the front end of the central support member 66 with the cable then extending downwardly under a swivel pulley 142 mounted on the front end member 18 with the cable 138 having a loop or hook 144 at the end thereof and a rubber ball stopper 146 spaced therefrom. The cable 138 also extends upwardly from the pulley 136 into engagement with and over a pulley 148 mounted on the longitudinal support beam or member 66 inwardly of the pulley 140 as illustrated in FIG. 1 with the cable then extending longitudinally of the member 66 and/over a rear end pulley 150 with the cable then extending downwardly and terminating in a hook or loop 152 and provided with a rubber ball stop 154 spaced therefrom thus enabling the weight stack 76 to be moved vertically by attaching handle structures at either of the ends 144 or 152. The weight stack 76 is also guided by guide members 156 in the same manner as the other weight stacks and the downward movement of the weight stacks 76 is cushioned by upstanding support members 158 in the form of short sections of pipe or the like having a cushioning element or pad on the upper end thereof. Also, a diagonal brace 160 extends between the front lower end member 18 and the rear end of frame member 64 and the inner end of frame member 62 for support thereof. A sleeve 162 is adjustably mounted on frame member 62 with a pulley 164 mounted thereon over which cable 138 can be positioned for connection with a curl bar or other exercise implement. By connecting various types of handles, gripping devices, ankle straps, neck straps, chest straps and the like to the cable ends, various exercise regimens can be followed. An unassisted wheelchair occupant can move the wheelchair forwardly into the framework as illustrated in FIG. 2 and secure the anchor straps 100 and the safety belt 110 and manipulate the various weight stacks by movement of various parts of the human anatomy thereby enabling the user to effectively proceed with a desired exercise procedure. The wheelchair occupant may reverse his position by backing the wheelchair into position as illustrated in FIG. 3 so that the rear periphery of the wheels 80 engage the stop assemblies 90 with the anchor strap and safety belt both being attached to the lower rearward end of the side member 16 so that additional exercise routines can be effectively practiced with the wheelchair and the wheelchair occupant being securely stablized in relation to the exercise equipment.

Figure 6:
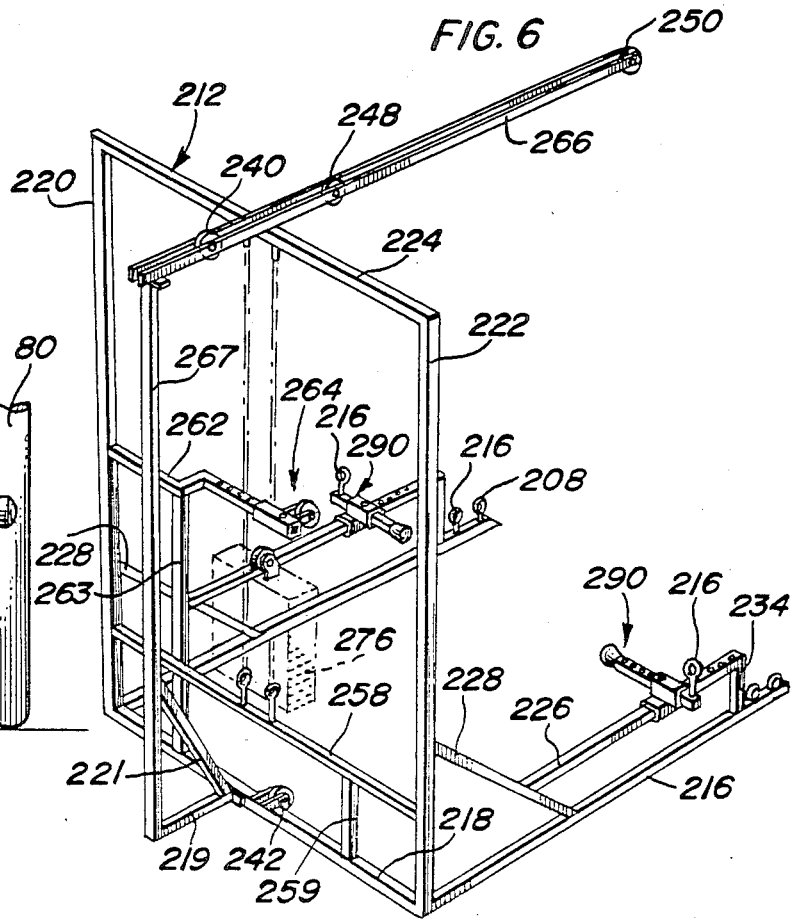
FIG. 6 is a perspective view of the home use embodiment of the invention.

FIG. 6 illustrates a modified and simplified form of the invention in which only a single weight stack 276 is provided and associated with an upright framework 212 including lower side members 216 and upright members 220 and 222 interconnected by a top member 224. The side members 216 are provided with partial side members 226 supported at one end by a vertical member 234 and at the other end by a diagonal brace 228 with an adjustable stop assembly 290 being supported on the side member 226 with eyebolts 208 and 216 being provided for the anchor strap assemblies and safety belt attachment. The lower end of the frame members 220 and 222 are interconnected by a front lower end frame member 218 with an end frame member 258 being spaced above the frame member 218 and supported by vertical members 259. A longitudinal beam or support member 266 extends perpendicular to the top frame member 224 and its forward end is supported by a vertical member 267 spaced from the vertical frame assembly 212 which extends downwardly with its lower end being connected to the end member 218 by a short frame member 219 and a diagonal brace 221. A frame member 262 extends inwardly and offset from frame member 220 and includes an adjustable pulley assembly 264 on the inner end thereof with a vertical member 263 extending downwardly from the offset portion of the frame member 262 for connection with the end member 258. The weight stack 276 is guided in the same manner as the weight stack 76 and includes the same padded support structures as the embodiment illustrated in FIG. 1 and the same pulley arrangement is provided for the weight stack 276 with a fixed pulley on the upper surface of the weight stack and a swivel pulley 242 on the end member 218 and pulleys 240, 248 and 250 being provided on the support member or beam 266. This unit is primarily intended for home use but still enables the wheelchair occupant to enter the framework and anchor and stabilize the wheelchair as well as the occupant with the wheelchair facing either forwardly or rearwardly with various exercise procedures being capable of effective performance.

In using the exerciser, the wheelchair occupant rolls the wheelchair into the framework either in facing relation to the weight stack 76 or 276 or in rearwardly facing relation. If the stop assemblies 90 or 290 are not properly adjusted, they can be adjusted by removing a pin and sliding the stop member inwardly or outwardly so that the inner ends of the stop members having a resilient cap thereon are positioned for engagement with the periphery of the wheel of the wheelchair. The occupant of the wheelchair then places a safety belt strap across his lap with the hook up of the safety belt strap being similar to that used in an automobile and the safety belt then can be pulled tight in substantially the same manner as in an automobile seat belt. The anchor strap or safety hook strap is then connected to the rear handle grip areas of the wheelchair and the hook strap is adjusted in length or tightened in the same manner as an automobile seatbelt so that the wheelchair is stabilized in secure relation to the exerciser and the occupant of the wheelchair is also stabilized by the safety belt strap.

The present invention provides an integrated exercise unit capable of both safely and effectively satisfying the diverse physical exercise requirements of patients temporaily or permanently confined to wheelchairs while affording such patients a maximum degree of independence in actual usage of the device. The device provides easy and efficient unassisted patient use throughout the full range of available exercises and resistances which readily accommodates circuit or aerobic weight training for improvement of cardiovascular fitness and cardiorespiratory endurance and functioning as well as muscular strength, flexibility and endurance training regimens. Essentially, the invention includes a framework of rigid structure with five guide rod mounted weight stacks operated by pulley systems utilizing plastic coated aircraft grade steel cable. The framework surrounds the wheelchair on three sides and securely locks the wheelchair in either forward or reverse position by wheel stops and wheelchair frame straps with the occupant being stabilized and secured in position by means of a lap safety belt. Interchangeable exercise bars, grips, harnesses and specialized attachment may be provided for individual users with the device being fully adjustable to the physical size, strength and flexibility of the individual users with all adjustments, apparatus selection and safety features being independently accomplished by the wheelchair occupant without any assistance.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An exercise device for use by wheelchair occupants comprising a framework including side components and end components at only one end of the side components with the other end of the side components being permanently open to enable a wheelchair to be rolled into and out of the area between the side components in forwardly or rearwardly facing direction in relation to the end components without removal and replacement of any components, adjustable means on the side components of the framework engaging the wheels on the wheelchair to limit the inward movement of the wheelchair into the framework, means connected with the side components of the framework for detachable and adjustable connection with the wheelchair to preclude outward and lateral movement of the wheelchair in relation to the framework and means connected with the side components of the framework to form a seatbelt engageable with the occupant of the wheelchair to stabilize the occupant in the wheelchair, said framework including vertically movable weight means and a cable and pulley system connected thereto and to the framework for attachment of user engaging means by which various exercises can be practiced by moving the weight means vertically.

2. The structure as defined in claim 1 wherein said means on the framework engaging the wheelchair wheels includes a pair of oppositely disposed, inwardly extending stop members laterally adjustably mounted on the side components for positioning in the path of movement of and engagement by the inner peripheral portion of the wheelchair wheels when the wheelchair is moved into the framework.

3. The structure as defined in claim 2 wherein said means connected with the side components for engaging the wheelchair includes a pair of adjustable straps having their outer ends connected to the side components, hook means on the inner ends of the straps for engagement with the handgrip areas of the wheelchair frame at a point remote from the engagement of the wheelchair wheel engaging means to stabilize the wheelchair in relation to the framework.

4. The structure as defined in claim 3 wherein said means stabilizing the wheelchair occupant in the wheelchair includes a lap-type seatbelt having the ends thereof anchored to the side components and provided with a centrally located connecting buckle and strap adjustment means to enable the seatbelt to be adjusted by the wheelchair occupant and connected to stabilize the occupant in relation to the wheelchair during various exercise regimens.

5. The structure as defined in claim 4 wherein said weight means includes a stack of weights oriented in the end of the framework and including vertical guide means guiding vertical movement of the weight stack in relation to the end components, said cable and pulley system including a plurality of pulleys located in vertically spaced relation to the stack and a cable assembly associated with the pulleys by which the weight stack could be moved vertically upon linear movement of the cable and means on the end of the cable for connection with various user engaging means and a stop member to prevent the cable from passing through the pulley adjacent the user engaging attachment means.

6. The structure as defined in claim 5 wherein said side components includes side vertical frames and said weight means includes a pair of vertically movable side weight stacks in each side frame with each side weight stack being vertically guided and provided with a cable and pulley system by which various user engaging means may be connected and moved in a manner to move the cable in a linear manner for raising and lowering the side weight stacks.

7. The structure as defined in claim 6 wherein said framework includes a longitudinally extending top beam located centrally of the framework and including pulleys receiving the cable from the vertically movable weight stack associated with the end components to provide flexibility in point of connection of user engaging means in relation to the cable for enabling various exercise regimens to be practiced.

8. The structure as defined in claim 7 wherein the end components includes a centrally located and laterally adjustable pulley for receiving the cable associated with the weight stack associated with the end components to enable a user engaging means to be oriented directly in front of the wheelchair and directly in back of the wheelchair when the wheelchair is associated with the framework frontwardly and rearwardly, respectively.

9. The structure as defined in claim 8 wherein each of said side components includes an elevated side member oriented horizontally end including a sleeve adjustable slidable thereon having a perpendicularly arranged sleeve rigid therewith for receiving the adjustable stop member with pin means securing the sleeve and adjustable stop member in longitudinally adjusted position.

10. The structure as defined in claim 1 wherein said side components include lower side members oriented only at the bottom portion of the framework and vertical frame components extending upwardly from the lower side members to support and guide the weight means with the area between the vertical frame components being void of obstructions except for the adjustable means engaging the wheelchair wheels.

11. An exercise device as defined in claim 1 wherein said side components of the framework include a pair of lower side members oriented in laterally spaced, horizontal position, a plurality of vertical upright members connected to the lower side members, a plurality of upper side members rigidly interconnecting the upper ends of the vertical members, a lower end member interconnecting one end of the lower side members, an upper end member interconnecting the upper ends of the upper side members, the other ends of the lower and upper side members being unconnected and free of obstructions to enable a wheelchair to be rolled into and out of the framework without removal of or replacement of any transversely extending members, said adjustable means on the framework engaging the wheels including a pair of inwardly extending stop members mounted on opposed portions of the framework above the lower side members, means enabling lateral and longitudinal adjustment of the stop members in relation to the framework for positioning the stop members for engagement by the large wheels on a wheelchair at a point spaced below the center line of the wheels, said means connected with the framework to preclude outward and lateral movement of the wheelchair including a pair of adjustable strap members connected to the lower side members and connected to the wheelchair in remote relation and opposed relation to the point of engagement between the stop members end wheelchair wheels to fixedly retain the wheelchair in relation to the framework, said seat belt extending adjustably across the lap of an occupant of the wheelchair and adjustably anchored to the framework adjacent the lower side members to stabilize an occupant in the wheelchair, said vertically movable weight means including a pair of oppositely disposed vertically movable weight stacks substantially aligned with the stop members, a second pair of opptositely disposed side weight stacks disposed between the stop members and the end members, and an end weight stack generally aligned with the end members and movable vertically in relation thereto, said framework including a centrally disposed horizontal beam extending perpendicular to the upper end member and supported fixedly in generally horizontal position with one end of the beam being disposed generally in alignment with the free end portions of the lower side members, a pulley and cable assembly connected to each of said weight stacks with each cable and pulley assembly including multiple cable segments and multiple pulley arrangements with each cable terminating in means to enable user engaging means to be attached to enable various exercise regimens to be practiced and enabling the wheelchair to be rolled into the framework in either a forward or reverse direction to enable all muscle groups to be effectively exercised.

* * * * *